US010550559B2

(12) United States Patent
Dudek

(10) Patent No.: US 10,550,559 B2
(45) Date of Patent: Feb. 4, 2020

(54) URINAL TOILET DEVICE

(71) Applicant: Miroslaw Dudek, Chicago, IL (US)

(72) Inventor: Miroslaw Dudek, Chicago, IL (US)

( * ) Notice: Subject to any disclaimer, the term of this patent is extended or adjusted under 35 U.S.C. 154(b) by 0 days.

(21) Appl. No.: 15/804,314

(22) Filed: Nov. 6, 2017

(65) Prior Publication Data

US 2018/0216327 A1 Aug. 2, 2018

Related U.S. Application Data

(60) Provisional application No. 62/453,887, filed on Feb. 2, 2017.

(51) Int. Cl.

| | |
|---|---|
| ***E03D 1/00*** | (2006.01) |
| ***E03D 9/03*** | (2006.01) |
| ***E03D 13/00*** | (2006.01) |
| ***E03D 9/02*** | (2006.01) |
| ***E03D 1/34*** | (2006.01) |

(52) U.S. Cl.

CPC ..... *E03D 1/003* (2013.01); *E03D 9/03* (2013.01); *E03D 13/00* (2013.01); *E03D 1/34* (2013.01); *E03D 2009/028* (2013.01)

(58) Field of Classification Search

CPC ..... E03D 1/003

USPC ..... 4/301, 363, 307, 340–342, 664, 666

See application file for complete search history.

(56) References Cited

U.S. PATENT DOCUMENTS

| | | | | |
|---|---|---|---|---|
| 3,018,488 | A * | 1/1962 | Liles | D06F 41/00 239/545 |
| 4,819,280 | A * | 4/1989 | Rickard | E03D 1/003 134/166 R |
| 5,299,328 | A * | 4/1994 | Walega | E03D 1/003 4/341 |
| 2002/0174483 | A1* | 11/2002 | Gallant | A61G 7/00 4/664 |
| 2009/0151059 | A1 | 6/2009 | Hsu | |
| 2012/0186009 | A1* | 7/2012 | Lin | E03D 1/003 4/341 |

FOREIGN PATENT DOCUMENTS

| | | | | |
|---|---|---|---|---|
| DE | 4302180 | | 7/1994 | |
| DE | 19602019 | | 7/1997 | |
| GB | 2467001 | A * | 7/2010 | E03D 1/00 |
| JP | 2008133705 | | 6/2008 | |
| KR | 100777165 | | 11/2007 | |

OTHER PUBLICATIONS

English machine translation of DE 43 02 180 A1, Reichenbach. Printed Feb. 27, 2019 (Year: 2019).*

International Search Report of the International Searching Authority prepared by the USPTO in connection with PCT/US2018/016645, dated May 14, 2018; Entire Document (13 pages).

* cited by examiner

*Primary Examiner* — Christine J Skubinna

(74) *Attorney, Agent, or Firm* — Richards Patent Law P.C.

(57) ABSTRACT

A modified toilet tank that serves as a fold-down urinal and fully functioning standard toilet in one to provide a more effective and mess-free way for males to use the toilet when urinating. The present urinal toilet device is more sanitary to use, eliminates messes on floors and toilet seats, is easier to use, and conserves water.

1 Claim, 10 Drawing Sheets

URINAL TOILET DEVICE

CROSS-REFERENCE TO RELATED APPLICATIONS

This application incorporates by reference and claims the benefit of priority to U.S. Provisional Application 62/453,887 filed on Feb. 2, 2017.

BACKGROUND OF THE INVENTION

The present invention relates generally to the field of urinal devices coupled to an existing toilet and more specifically relates to a modified toilet tank that serves as a fold-down urinal and fully functioning standard toilet in one to provide a more effective and clean method for males to use the toilet when urinating.

While toilets are an important necessity, many consumers who live in households with male children, teens, or adults find that this most useful amenity has several drawbacks. Specifically, men and boys alike can forget to raise the toilet seat before using the facilities, and even if they do raise the seat, conventional toilets do not provide the most optimal system for male urination from both a hygienic point of view, as well in terms of water conservation.

The usage of commodes and urinals are known in the art. Generally, it has been common practice to provide a water tank incorporating a flushing device in association with a commode to help dispose of contents within a toilet bowl and down a drainpipe. The toilet bowl typically includes a seat and a lid attached thereon and is supported by a base. A base plate is normally mounted onto a floor in order to securely support the base of the toilet. In contrast, a standard urinal includes a urinal bowl and a flushing apparatus attached to the bowl. A urinal-rinsing line is positioned within the bowl to release water through rinsing apertures. Here, when the flushing apparatus is activated, water cascades downward into the bowl and down a drainline in order to refresh the bowl for subsequent usage. However, these standard commodes and urinals, as two separate entities, have necessitated substantial special requirements and have promoted excess water utilization during the flushing processes.

Several attempts have been made to redesign such combination urinal and toilet units in order to provide direct drainage from a urinal into the drain hole of a commode. An example of these devices is a urinal device having a urinal bowl that is supported adjacent to a toilet. The bowl includes an outlet drain to which an outlet drain line is connected in order to directly drain into the drain line rather than into the toilet bowl. Preferably, the urinal bowl includes a bowl-rinsing line affixed to the conventional bowl flushing and filling assembly so that whenever the toilet is flushed, the urinal bowl is rinsed. However, such system is complicated by requiring a separate urinal bowl adjacent to the toilet bowl, and does not address water conservation efforts.

Accordingly, a need exists for a reliable urinal device that serves as a urinal and fully functioning standard toilet in one to provide a more effective and hygienic way for males to use the toilet when urinating.

BRIEF SUMMARY OF THE INVENTION

The present disclosure provides a urinal toilet apparatus. Various examples of the systems are provided herein.

The general purpose of the present invention is to provide a modified toilet tank that serves as a fold-down urinal and fully functioning standard toilet in one to provide a more effective and mess-free way for males to use the toilet when urinating. The present device is more sanitary to use, eliminates messes on floors and toilet seats, is easier to use, and conserves water. The features of the invention which are believed to be novel are particularly pointed out and distinctly claimed in the concluding portion of the specification.

The present device can provide a means for men and boys to neatly urinate in a common toilet, without ever having to put one's hands on the lid or the seat itself. By opening the door to the urinal, one can easily attend to their bathroom needs, closing it after use, causing the unit to flush. Helping ensure that the toilet seat and the surrounding floor remains clean and dry, the present device should be appreciated by all members of the household, male and female.

The present device protects the user from coming into direct contact with the germs and bacteria that are often found on the underside of the toilet seat and lid. Easy to use, this unique product could prove an invaluable accessory in any home or public lavatory.

An advantage of the present device is it is more sanitary to use, eliminates messes on floors and toilet seats, is easier to use, and conserves water and to avoid the above-mentioned problems.

A further advantage of the present device is providing a system that promotes water conservation, by reducing the number of times a toilet is flushed. Specifically, when the urinal is utilized and is subsequently flushed, the disposed fluid will bypass the toilet bowl and enter into the passageway of the base of the toilet and down the drain line.

Another advantage of the present system is to provide a urinal that is integrally part of a conventional toilet, in contrast to conventional systems that attach a separate urinal to the toilet.

An advantage of the present system is providing a urinal that is capable of being attached to an existing toilet. Once the present tank is coupled to the toilet, the urinal may be drained directly a urinal drainage system rather than into the toilet.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

The present system relates to urinal devices coupled to a toilet and more particularly to a modified toilet tank that serves as a fold-down urinal and fully functioning standard toilet in one to provide a more effective and mess-free way for males to use the toilet when urinating.

Figure 1A:
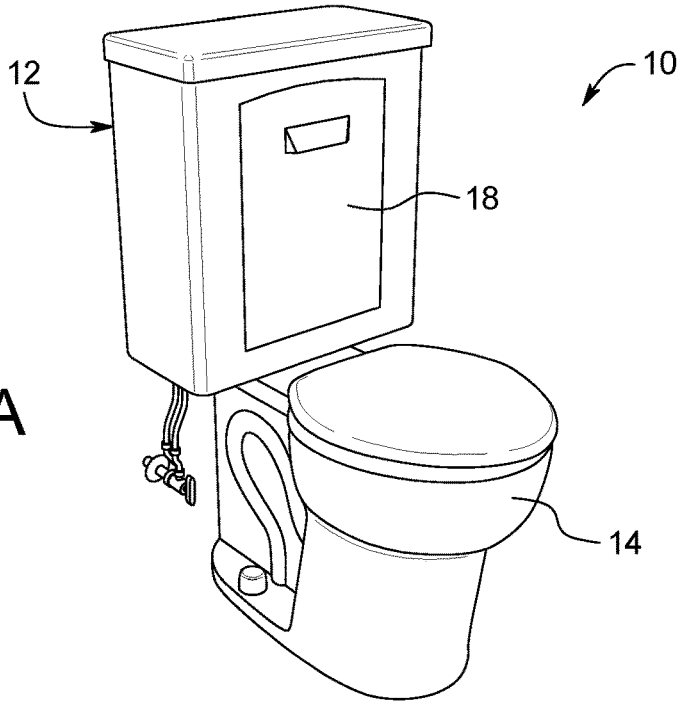
FIGS. 1A-1B are perspective views of the present system, wherein in FIG. 1A the urinal door is closed, and wherein FIG. 1B the urinal door is open exposing the urinal for use.
Figure 1B:
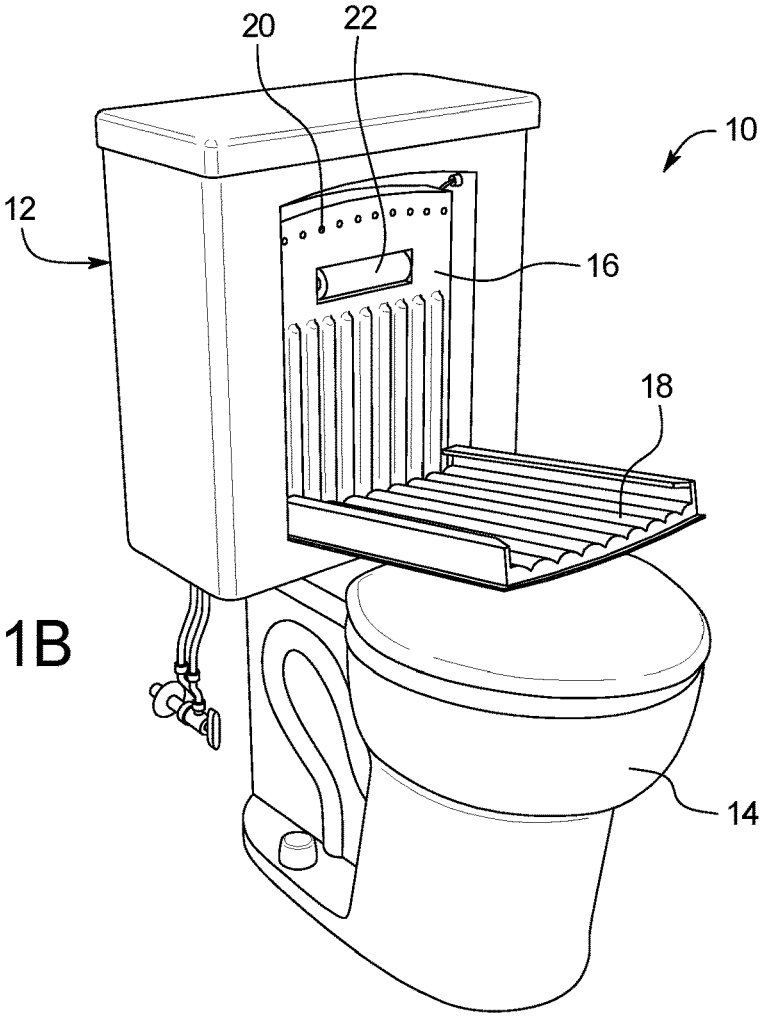

As shown in FIGS. 1A-1B, the present device 10 includes a toilet tank 12 that can rest on top of a standard commode 14 assembly. In an example, the toilet tank can have a rectangular in shape, the unit would measure approximately twenty-seven inches (27") in height, twenty-one inches (21") in width, and eight inches (8") in depth. Appropriate for use in both home and public bathrooms, the present device could be made available in a variety of colors and materials. In an example, the present toilet tank can be installed at point of manufacture of toilets or as an after-market product that could be added to existing toilet assemblies.

The toilet tank 12 can include a urinal 16 that can be accessed by opening a urinal door 18. The urinal door 18 can be connected to the front surface of the toilet tank 12 via a hinge joint, wherein the opening and closing of the door exposes and conceals the urinal 18, as shown in FIGS. 1A-1B. In an example the door 18 and/or urinal 16 can be rectangular or in an oval shape.

Figure 3A:
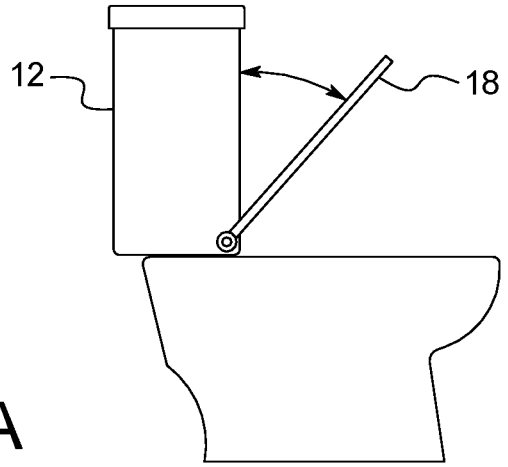
FIG. 3A-3B are side views of the system illustrating the opening and closing of the urinal door via a hinge and spring system.
Figure 3B:
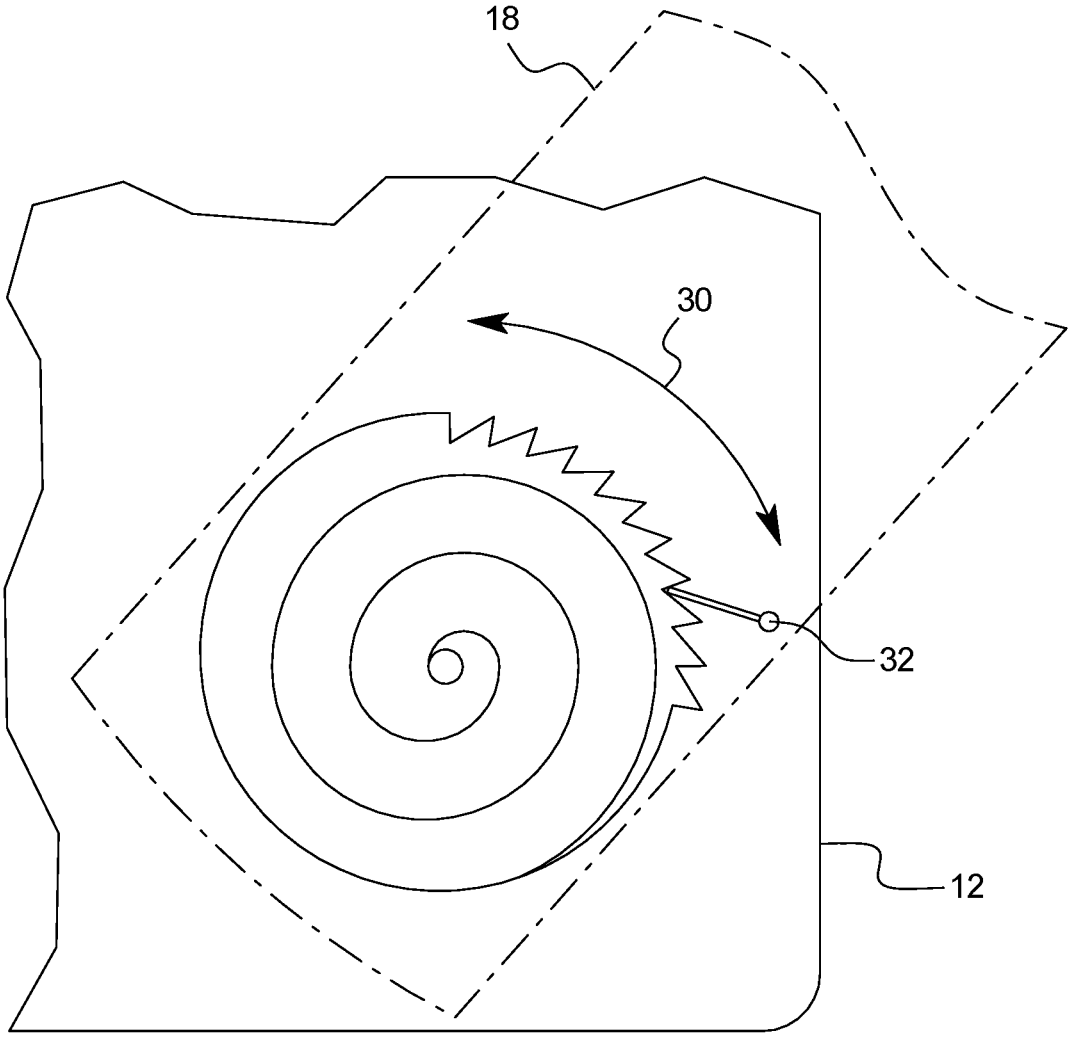

The front side of the toilet tank 12 can include a pull-down door 18 that reveals the interior of the tank 12 including the urinal 16. When opened, the door 18 to the tank 12 covers the existing toilet bowl 14, urine would be directed inside the urinal 16, drain into the urinal drain system 44. When finished, the door 18 can be closed, and the urinal can automatically flush the urine through the urinal drainage system 44 via a rinse assembly 20 (e.g., a water distribution sprinkler assembly including a plurality of sprouts or openings to release water onto the surface of the urinal) at the inside top of the urinal 16. As shown in FIGS. 3*a*-3B, the door 18 can include a spring 30 and a stopper 32, such that the door can open until the opening of the door 18 is stopped with the stopper, wherein the door in its open position is substantially parallel with the toilet cover. However, the door can be positioned in any position that is suitable to the user's height or needs. The door 18 can stay open until the spring is released and the door can close back to the front surface of the tank 12. The door 18 can spring back into the closed position, or the user can guide the door to its closed position. Alternatively, or in addition to, the door 18 can be locked and unlocked by the user to move from an open and closed position. The locking mechanism can be any suitable lock that can be manipulated by the user from a locked position to an unlocked position, wherein the unlocked position allows the user to open the door.

In an example, the system can contain a cleaning solution dispensing mechanism 22, which can be filled with cleansing chemicals that may be dispensed during or after the urinal flushing mechanism is activated. The cleaning solution dispensing mechanism 22 can be positioned below the rinse assembly 20 such that the soap and/or cleansing solution is rinsed from the urinal 16 after or during flushing. The cleansing solution dispensing mechanism 22 can include a soap container that can be replaced or refilled with cleansing solution. The cleaning solution dispensing mechanism can include a switch, wherein upon activation of the switch by the user, the cleaning solution or water can be dispensed down the surface of the urinal 16. The same or a different switch can be used to dispense soap from the soap dispenser separately or concomitantly.

Figure 2:
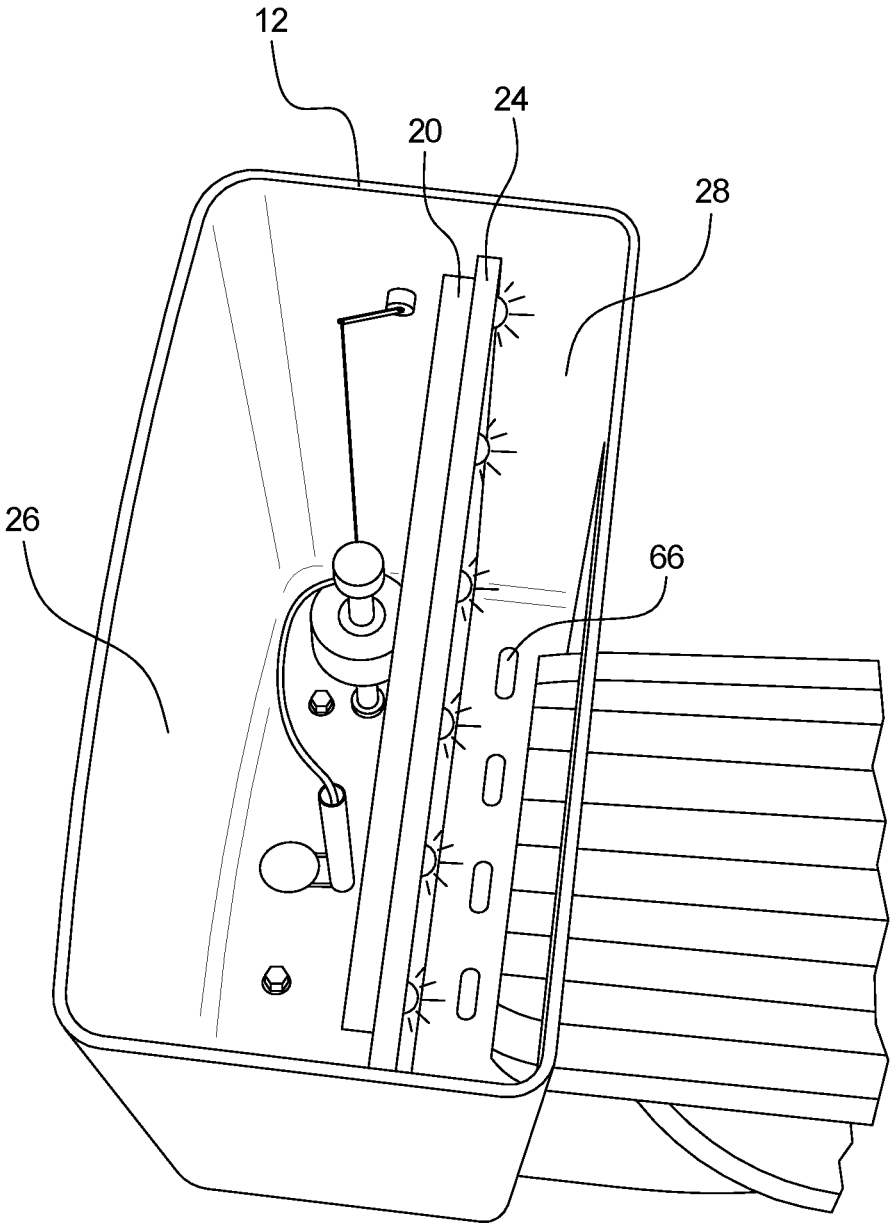
FIG. 2 is a top view of an example of the interior of the tank.
Figure 7:
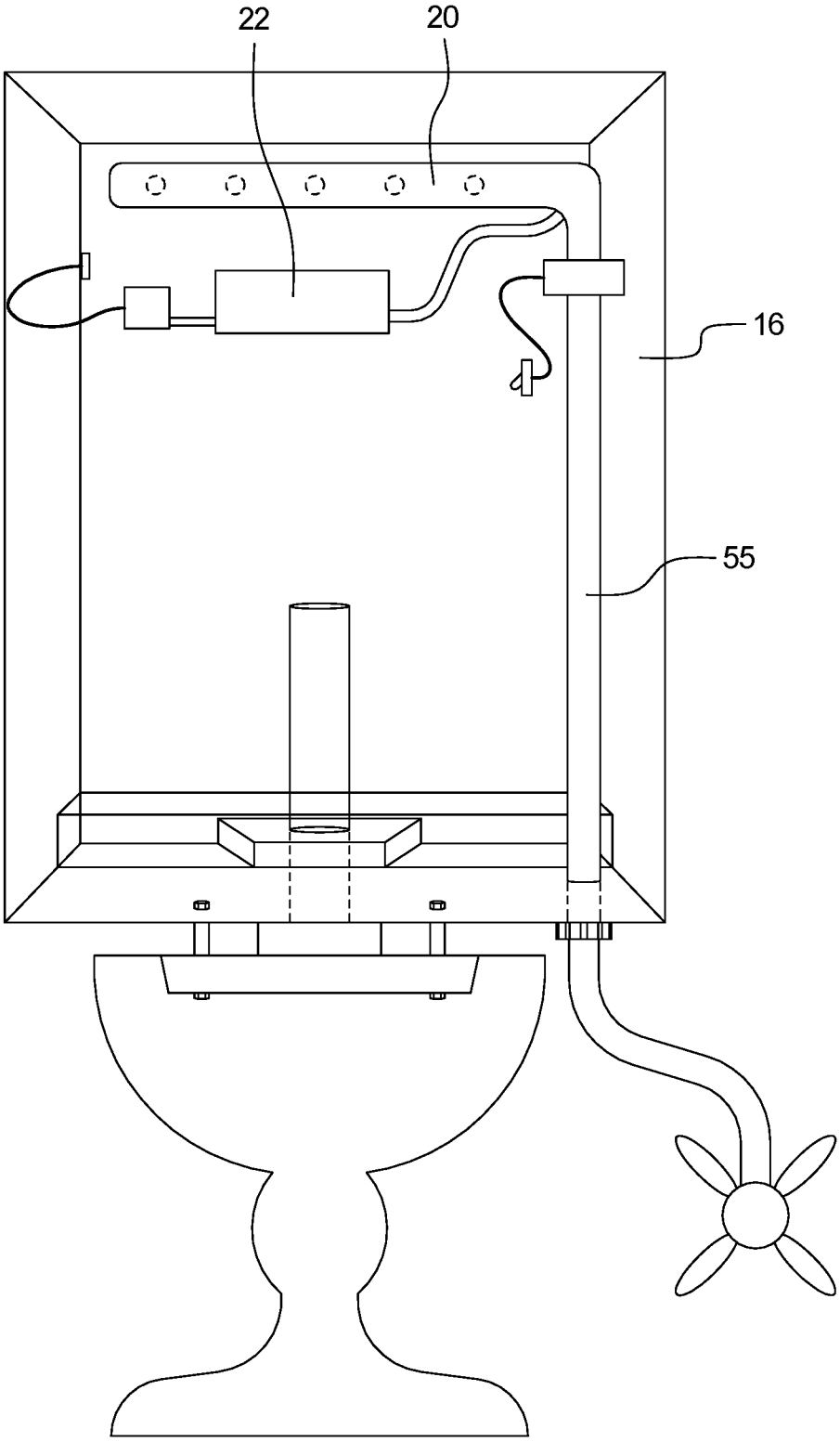
FIG. 7 is a front view of the urinal illustrating the rinsing mechanism and soap dispenser.

As shown in FIGS. 2 and 7, the tank 12 can include a divider 24 that separates the interior of the tank into a urinal portion 28 and a toilet tank portion 26. The urinal 16 can include a rinse assembly 20 that rinses the urine from the urinal 16. In an example, the rinse assembly 20 includes a plurality of openings connecting to a water source 55, wherein the water can be dispensed through the openings and onto the surface of urinal 16. The openings can include spouts that direct the cleaning solution onto the surface of the urinal 16. The water solution can include disinfectant or any other cleaning solution.

The flushing mechanism used with respect to the urinal can be separate from the toilet bowl flushing mechanism, and requires much less water than that of the standard toilet bowl flushing mechanism. As a result, the present device uses much less water than a conventional toilet, resulting in significant water conservation, and thus making the device environmentally friendly.

Figure 4:
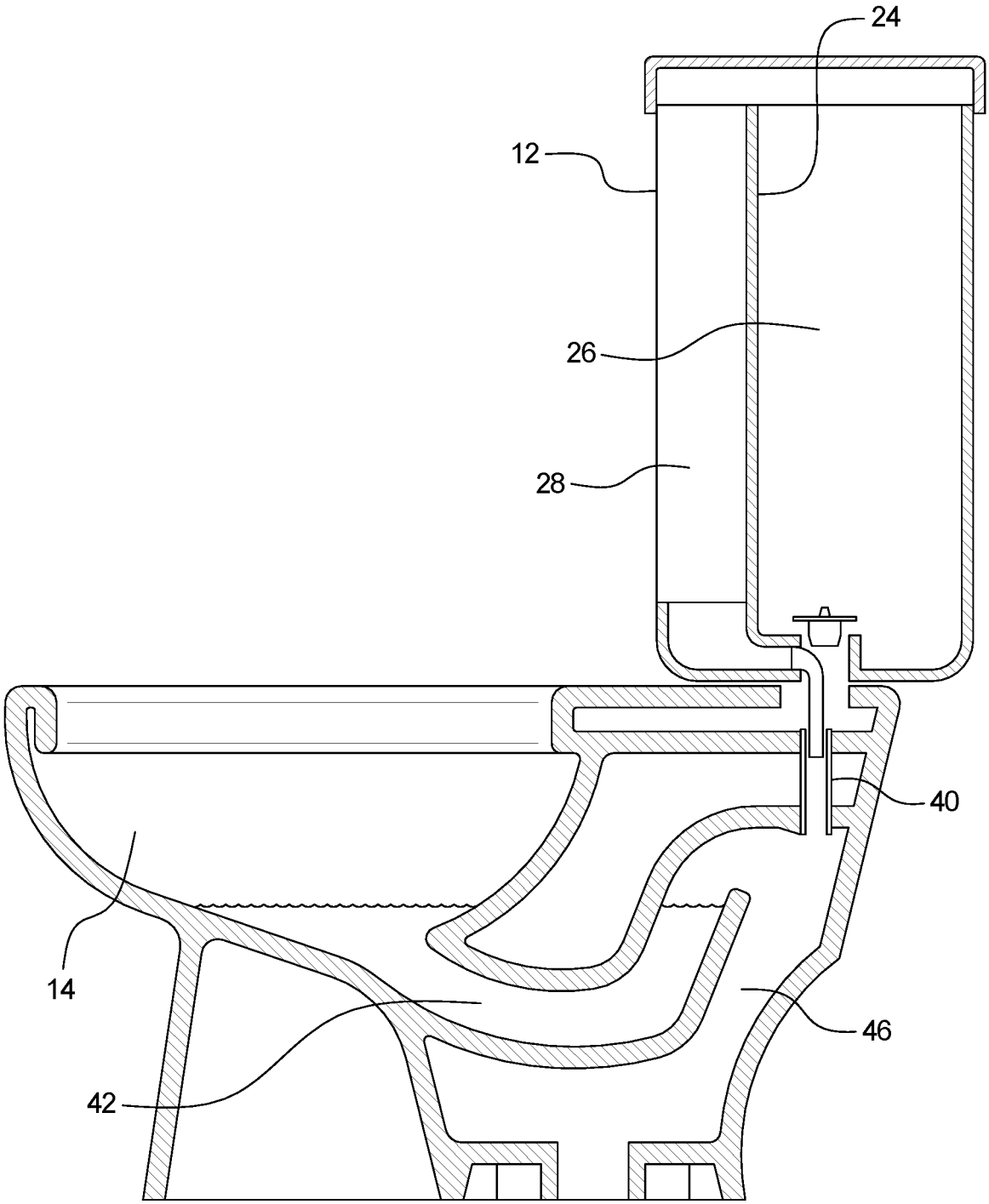
FIG. 4 is a side view of the urinal device illustrating when the urinal is not in use, the tank operates conventionally using the flushing mechanism.
Figure 5:
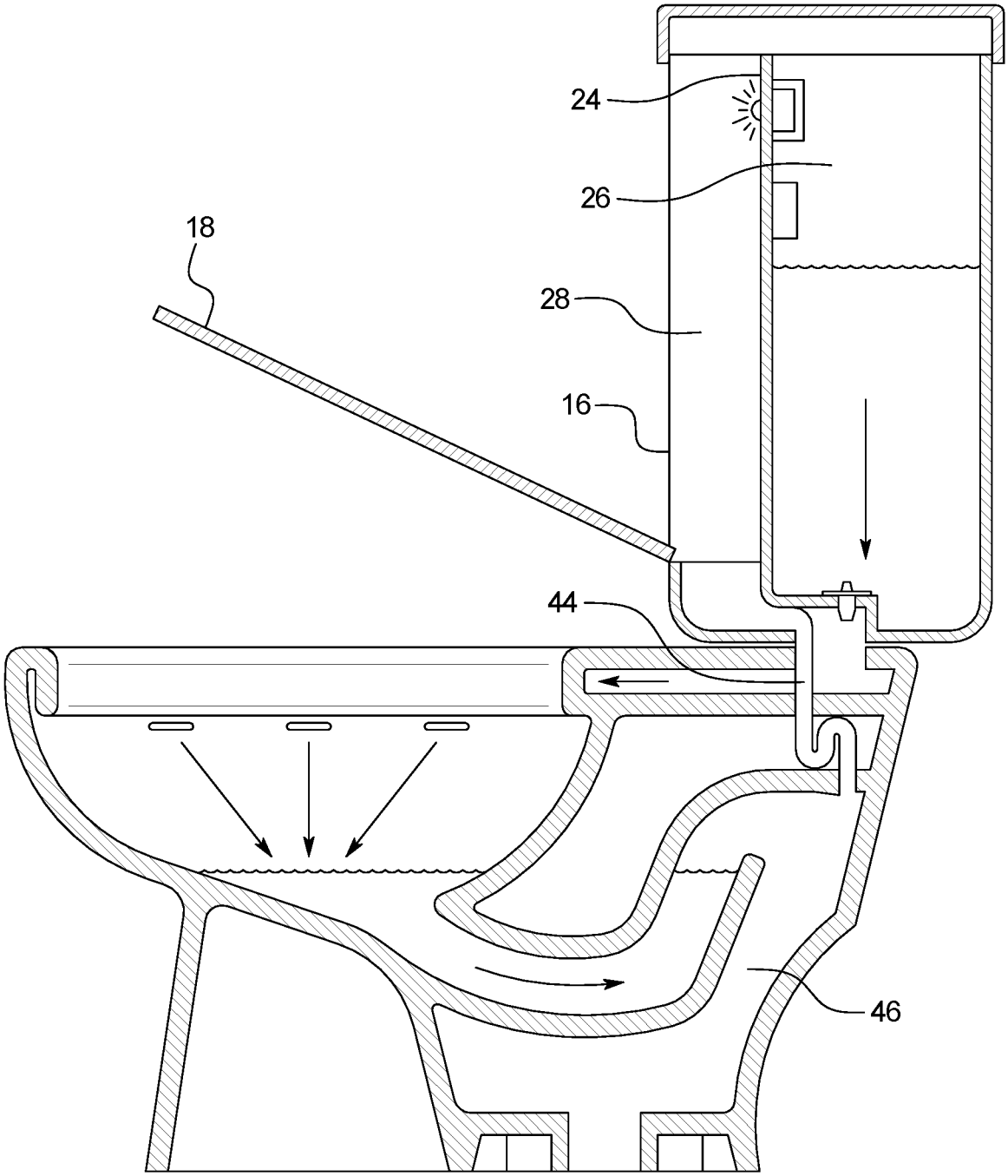
FIG. 5 is a side view of the urinal device illustrating when the urinal is in use, wherein the urinal drainage system bypasses the conventional flushing mechanism and flows directly into the drainline.

As shown in FIGS. 4-5, the toilet drainage 40 from the tank toilet portion 26, via opening 60, flows into the drainline 46 along with that of the toilet liquid 42 via the drain opening 60 when flushed. The edge of the toilet drainage 40 keeps the urinal drain system 44 clean. As shown in FIG. 5, the liquid from the urinal 16 flows through the urinal drain system 44 directly into the drainline 46, bypassing and not combining with the toilet liquid 42.

In an example, the position of the door 18 can dictate which drainage system, between the urinal drainage and toilet drainage, is used. As shown in FIG. 4, when the door 18 is closed, the toilet drainage 40 from the tank toilet portion 26 flows into the drainline 46 along with that of the toilet liquid 42 when flushed. As shown in FIG. 5, when the door 18 is open, providing access to the urinal 16, the liquid from the urinal 16 flows through the urinal drainage 44 directly into the drainline 46, by passing and not combining with the toilet liquid 42.

Figure 6:
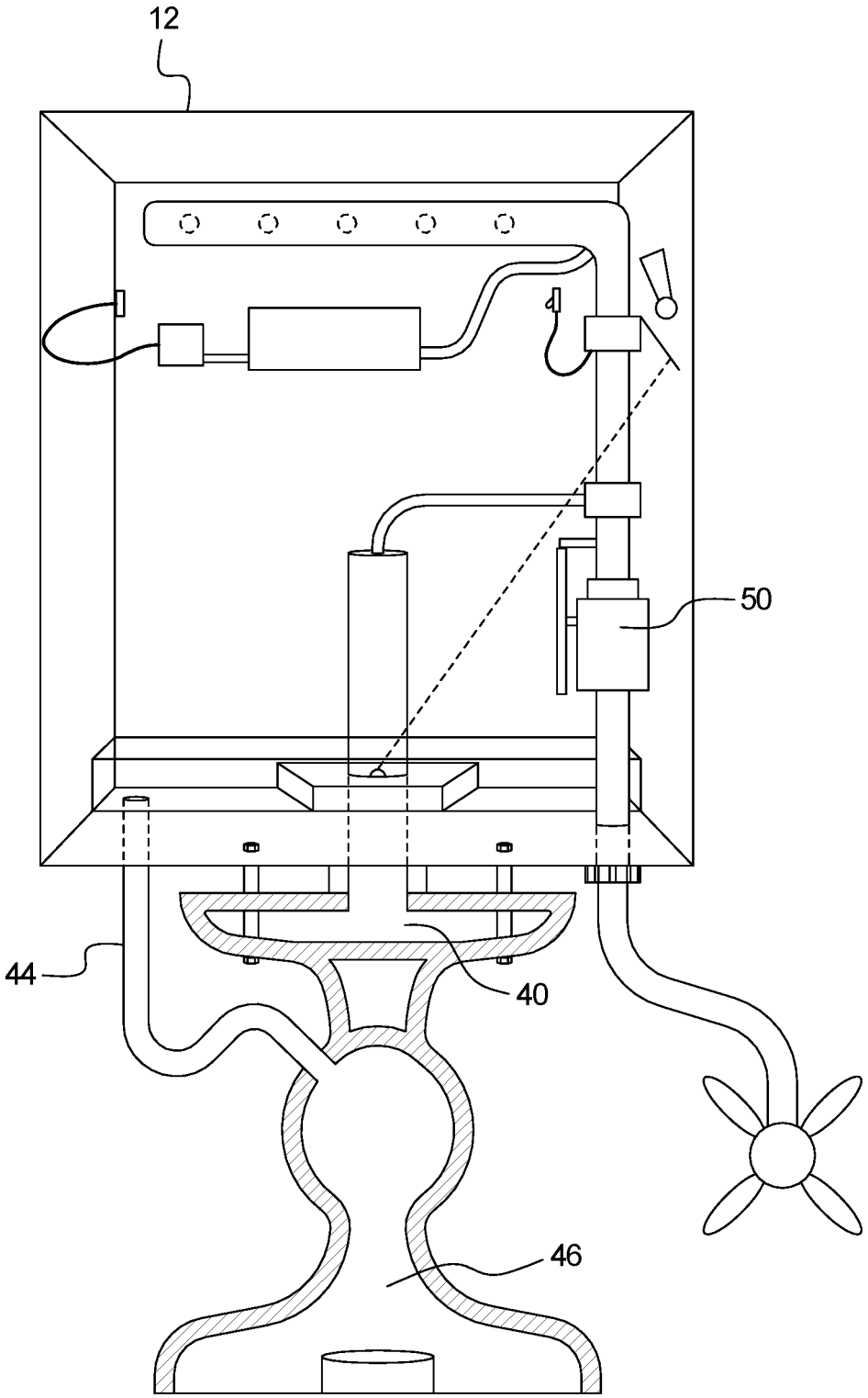
FIG. 6 is a back view of an example of the present system illustrating the separate drainage systems for the urinal and the toilet.

FIG. 6 includes a back view of the tank 12 including a conventional flushing system 50. As shown, both the toilet drainage system 40 and the urinal drainage system 44 both lead into the drainline 46, albeit separately. The convention flushing system 50 connects to the tank drain opening 60, which is in fluid communication with the toilet liquid 42, which is in fluid communication with the drainline 46. The toilet drainage 40 and urinal drainage system 44 are in fluid communication with the drainline 46.

Figure 8A:
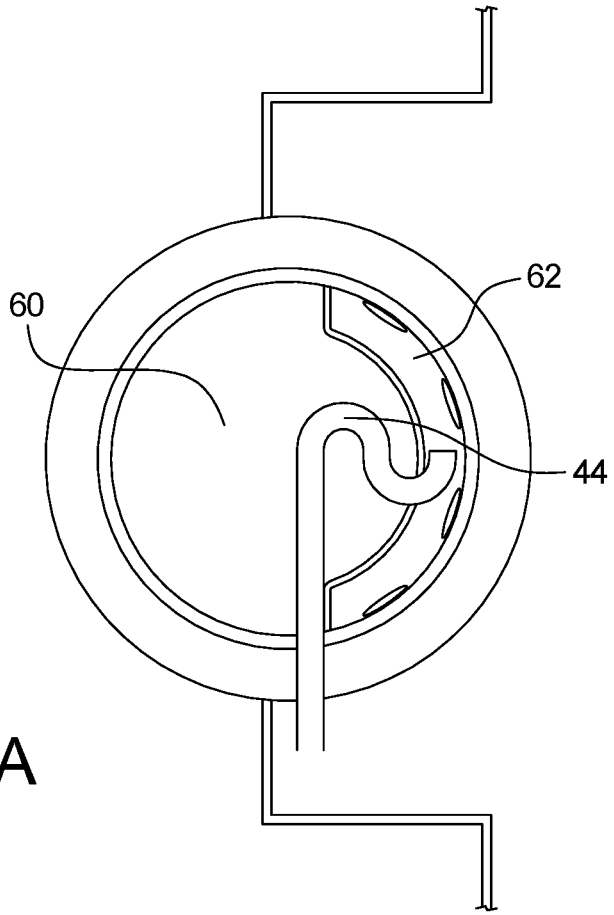
FIG. 8A-8B are top and side views, respectively, of the tank drainage opening in the bottom of the tank, wherein the urinal drain is directed separate from that of the tank drainage opening.
Figure 8B:
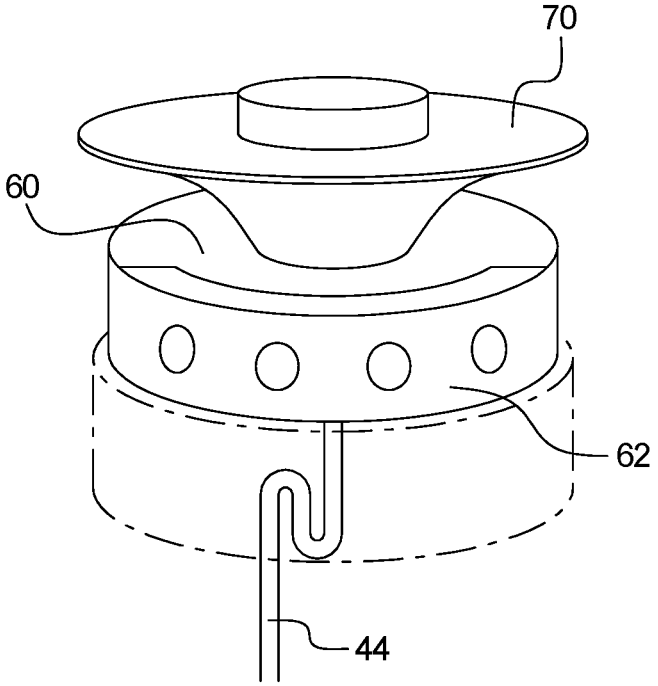

FIGS. 8A-8B illustrates a top view and a side view, respectively, of the tank drain opening 60 that is positioned at the bottom of the tank 12 and leads into the toilet drainage system. FIG. 8B illustrates a standard flap valve 70 that removeably rests in the tank drain opening 60, and lifts upon flushing the toilet as known. As shown, an outer portion 62 of the opening directs the fluid from the urinal 16 into the urinal drainage system 44, wherein the urinal drain openings 66 can direct the fluid into the outer portion 62 and ultimately into the urinal drainage system 44. The tank drain opening 60 directs fluid from the tank into toilet drainage 40.

Figure 8C:
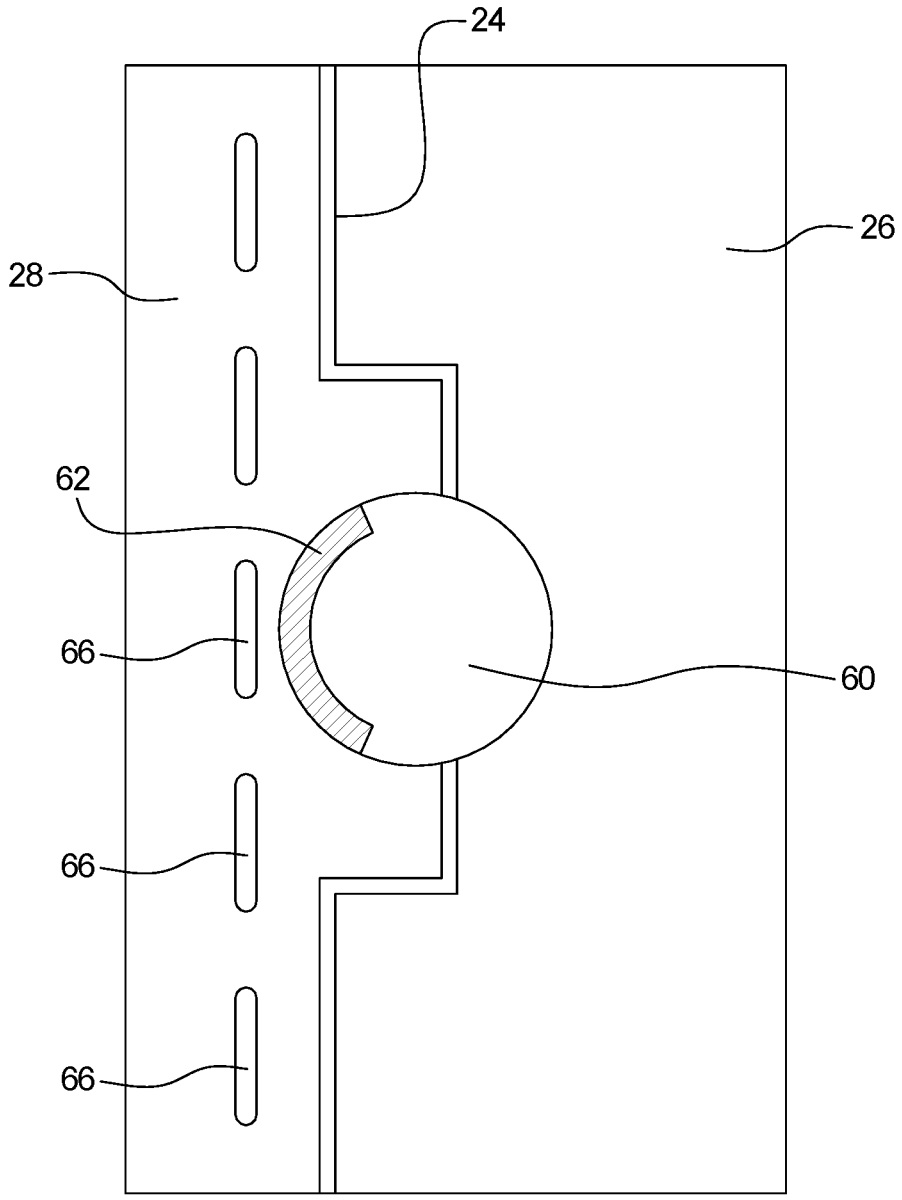
FIG. 8C is a top view of the tank illustrating a front portion and back portion divided by a divider.
Figure 8D:
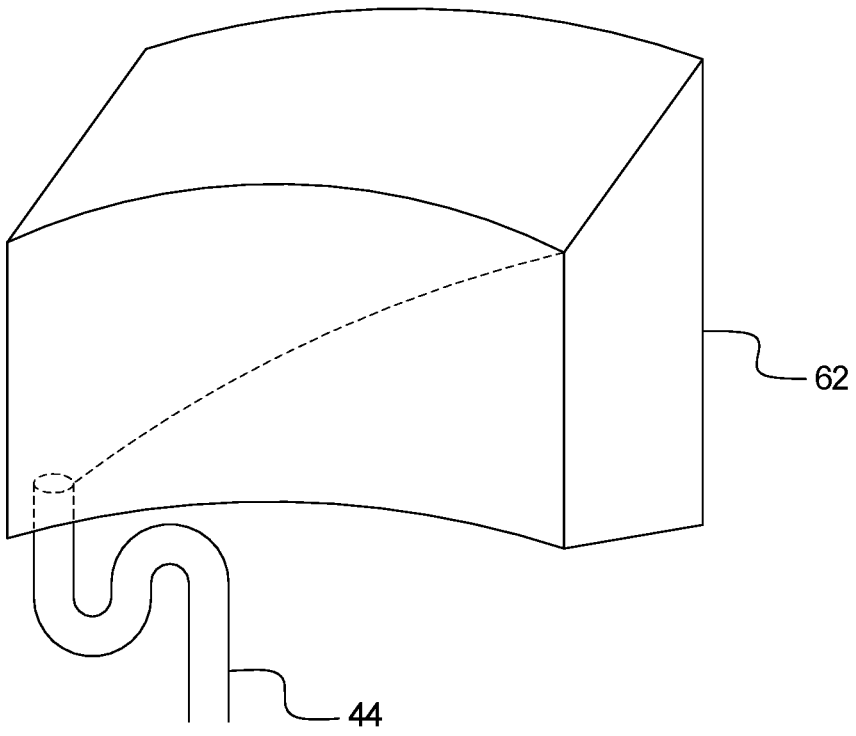
FIG. 8D is a side view of a tank drain.

FIG. 8C is a top view of the bottom of tank 12 illustrating the tank drain opening 60, wherein an outer portion 62 of the tank drain opening 60 connects to the urinal drainage system 44, separate from the liquid entering the tank drain opening 60, such that liquid from the urinal 16 flows through the outer portion 62 of the opening into the urinal drainage system 44, wherein the liquid from the back portion of the tank flows through the opening 60 into the toilet drainage 40. As shown in FIG. 8C, the bottom of the urinal 16 can include a plurality of urinal drain openings 66, wherein liquid from the urinal can flow through the urinal drain openings 66 into the outer portion 62 of the opening of the drain opening 60, or wherein the liquid from the urinal can flow from the urinal drain openings 66 directly into the urinal drainage 44. FIG. 8D, is an example of the shape inside the drain.

In an example, the length of the tank can be 20-22 inches, and the with of the tank can be 7-10 inches, e.g., 8 inches. In an example, the front portion 28 can have a width of 2-4 inches, e.g., 2.5 inches. The outer portion 62 can be ¼ of an inch thick, and the diameter of the tank drain opening 60 can be 1.5 to 3 inches, e.g., 2 inches.

The system can include a urinal rinse handle that when pressed activates the water source to release water from the rinse assembly 20 such that water or cleansing liquid can flow down the surface of the urinal and into the urinal drain openings 66. The rinse assembly can include the soap dispensing mechanism 22 such that the water can flow over and direct the released soap to flow down the surface of the urinal 16 and into the urinal drain openings 66. Alternatively, or in addition to, the urinal rise assembly 20 can be activated by merely closing the door 18, such that when the door is closed after being opened, the rise assembly 20 is activated to release water and rinse the urinal 16. The soap can include specific smells such as fruit, floral, perfume, among others.

The flushing mechanism can include a separate water line from the main water valve conventionally used for toilet flushing. The separate water line for the urinal can include a water timer valve with a sensor switch to activate the rinsing mechanism, including the soap dispensing mechanism. The sensor switch can be installed on an outer surface of the tank, wherein a user can depress the switch to activate the urinal flushing mechanism. Alternatively, the act of closing the door can activate the sensor switch to activate the urinal flushing mechanism. As a result of the urinal flushing mechanism, the system is self-cleaning.

The tank 12 can be attached to a conventional toilet bowl including a water tank incorporating the toilet flushing mechanism in association with a commode to help dispose of contents within a toilet bowl and ultimately down the drainpipe. The toilet bowl typically includes a seat and a lid attached thereon and is supported by a base. A base plate is normally mounted onto a floor in order to securingly support the base of the toilet. When the flushing apparatus is activated, water cascades downward into the bowl and down a drain line in order to refresh the bowl for subsequent usage.

In an example, a conventional toilet bowl can be modified by drilling a ¼-½ inch hole in the toilet bowl, wherein the hole is connected to a pipe that connects with the urinal drain system to the toilet bowl. Alternatively, a side connection can be used wherein a hole can be drilled on the side of the toilet bowl and using the urinal drain hose to connect with the main toilet drain. In another example, the main toilet base head can include a side drain hole for the urinal connection for connecting to a trap hose from the urinal drain to drain directly to the toilet drain system. Alternatively, the present system can be made in one pieces including the present tank including the disclosed draining system and toilet bowl.

In addition, the present system can include at least one light, such as an LED light. The LED light can be activated by opening the urinal door 18, and deactivated upon dosing the door. In addition, the present system can include a musical system including a speaker, wherein the music is activate upon opening the urinal door and the music ceases upon dosing of the urinal door. Music or sound, such as running water, can be used to mentally help users relieve themselves.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

I claim:

1. A urinal toilet tank device comprising:

a tank including a front side, a back side, a first side, and a second side surrounding an inner cavity that is divided into a front portion and a back portion by a divider, wherein the divider spans a top of the tank to a bottom of a tank and a first side of the tank to a second side of the tank;

the front portion including a door in the front surface of the tank, wherein the door pivots between a closed position and an open position, wherein in the closed position a front face of the door is flush with the front surface of the tank, wherein in the open position the door is positioned above a toilet seat of a toilet and covers the toilet seat;

the divider including a rinse assembly including a plurality of openings positioned along a top portion of the divider, wherein the openings are in fluid communication with a water source, and a user activated refillable cleaning solution dispensing unit positioned below the plurality of openings such that upon user activation cleaning solution is released onto the divider;

a urinal drain system including at least one urinal drain opening located along a bottom surface of the front portion of the tank, wherein the urinal drain opening is connected to a urinal drain pipe;

a toilet drain system including a tank drain opening positioned at the bottom of the back portion of the tank, wherein the tank drain opening is in fluid communication to a toilet drain pipe, wherein the toilet drain pipe is in fluid communication with a toilet bowl;

a drainline positioned within a toilet base for waste disposal;

a urinal flushing mechanism that automatically responds to a user closing the door to causes water to flow through the plurality of openings, rinsing the divider below the plurality of openings, including any cleansing solution located thereon, such that the water drains from the front portion into the drainline through the urinal drain pipe, after which the toilet drain pipe fluidly connects to the drainline; and toilet bowl flushing mechanism that responds to a user action to cause water from the back portion of the tank to flow through the toilet drain system into the toilet bowl and then into the drainline.

* * * * *